US006618487B1

(12) United States Patent
Azima et al.

(10) Patent No.: US 6,618,487 B1
(45) Date of Patent: Sep. 9, 2003

(54) ELECTRO-DYNAMIC EXCITER

(75) Inventors: Henry Azima, Cambridge (GB); Martin Roberts, Suffolk (GB); Edward Jarvis, Cambridgeshire (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/355,312

(22) PCT Filed: Jan. 30, 1998

(86) PCT No.: PCT/GB98/00307

§ 371 (c)(1),
(2), (4) Date: Oct. 15, 1999

(87) PCT Pub. No.: WO98/34320

PCT Pub. Date: Aug. 6, 1998

Related U.S. Application Data

(63) Continuation-in-part of application No. 09/011,773, filed on May 13, 1998, and a continuation-in-part of application No. 08/707,012, filed on Sep. 3, 1996.

(30) Foreign Application Priority Data

Jan. 31, 1997 (GB) ..... 9701983

(51) Int. Cl.[7] ..... H04R 25/00

(52) U.S. Cl. ..... 381/152; 381/396; 381/403; 381/420

(58) Field of Search ..... 381/337, 152, 381/386, 396, 151, 412, 417, 420, 431, 338, 403, 404, 433

(56) References Cited

U.S. PATENT DOCUMENTS

| | | | | |
|---|---|---|---|---|
| 3,430,007 A | * | 2/1969 | Thielen | 381/152 |
| 3,801,943 A | | 4/1974 | Bertagni | 335/231 |
| 4,256,930 A | | 3/1981 | Garner et al. | |
| 4,359,133 A | | 11/1982 | Krolak | |
| 4,384,174 A | | 5/1983 | Suzuki et al. | |
| 4,465,905 A | | 8/1984 | Nation | |
| 4,506,117 A | | 3/1985 | Fresard | 179/114 R |
| 4,514,599 A | | 4/1985 | Yanagishima et al. | 179/181 W |
| 4,665,550 A | | 5/1987 | Haas | |
| 4,720,868 A | | 1/1988 | Hirano | 381/182 |
| 4,914,750 A | | 4/1990 | Lawson | 381/152 |
| 4,926,486 A | | 5/1990 | Barsumian | 381/152 |
| 6,192,136 B1 | * | 2/2001 | Azima et al. | 381/338 |
| 6,208,237 B1 | | 3/2001 | Saiki et al. | 340/388.1 |
| 6,332,029 B1 | * | 12/2001 | Azima et al. | 381/152 |

FOREIGN PATENT DOCUMENTS

| | | |
|---|---|---|
| RU | 2098926 | 12/1997 |
| WO | WO 88/08239 | 10/1988 |

OTHER PUBLICATIONS

Azima et al., "Loudspeakers", Ser. No. 09/341,295, Filed Jan. 5, 1998 (as PCT/GB98/00014), including copy of PCT/GB98/00014, IPER and copy of pp. 4–7 of Amendment filed Jun. 4, 2001 reflecting claims as presently pending.

* cited by examiner

*Primary Examiner*—Huyen Le
(74) *Attorney, Agent, or Firm*—Foley & Lardner

(57) ABSTRACT

An electro-dynamic inertial vibration exciter (1), for exciting a member (2) having capability to sustain and propagate input vibrational energy comprising a motor coil assembly (3, 4) having a coil (3) rigidly fixed to a tubular coil former member (4), a magnet assembly (5, 6, 7) disposed concentrically with respect to the motor coil assembly, and means (11) suspending the magnet assembly for axial movement relative to the motor coil assembly, characterized by a carrier (9) supporting the motor coil assembly (3, 4) and adapted for connection to the member (2) to be excited.

44 Claims, 8 Drawing Sheets

ELECTRO-DYNAMIC EXCITER

This application is a continuation-in-part of application Ser. No. 08/707,012, filed Sep. 3, 1996, and application Ser. No. 09/011,773, filed May 13, 1998 as PCT/GB96/02167 (published Mar. 13, 1997 under No. WO 97/09859).

DESCRIPTION

1. Technical Field

The invention relates to an electro-dynamic exciter e.g. for use in activating a resonant panel-form radiator loudspeaker of the kind described in co-pending parent application Ser. No. 08/707,102.

2. Background Art

More particularly, the present invention is an electro-dynamic inertial vibration exciter, e.g. of the general kind described in parent application Ser. No. 09/011,773 which describes an inertial vibration exciter comprising a motor coil assembly having a c oil rigidly fixed to a tubular coil former, a magnet assembly disposed concentrically with respect to the motor coil assembly and forming an inertial mass, and resilient means supporting the magnet assembly for axial movement relative to the motor coil assembly, and wherein the tubular member, is adapted to be rigidly mounted directly to a member to be vibrated, e.g. a resonant panel loudspeaker, by adhesive means.

The present invention relates to the efficient construction of exciters and to manufacturing techniques for producing such exciters.

DISCLOSURE OF INVENTION

According to the invention an electro-dynamic inertial vibration exciter for exciting a member having capability to sustain and propagate input vibrational energy and comprising a motor coil assembly having a coil rigidly fixed to a coil former member, a magnet assembly disposed concentrically with respect to the motor coil assembly, and movable axially relative to the motor coil assembly, on an axially compliant suspension is characterised by a carrier supporting the motor coil assembly and adapted for connection to the member to be excited. The carrier may be directly connected to the coil former member. The suspension means may be connected to the carrier. A coupling member may be connected to the carrier via the suspension member, which coupling member is adapted to carry the magnet assembly.

The coupling member and the magnet assembly may be adapted to interfit one with the other, and means may be provided on the coupling member and on the magnet assembly for fixing the coupling member and magnet assembly together. The fixing means may comprise at least one chip. The carrier and the suspension member may be integral. The coupling member and the suspension member may be integral. The suspension may be resilient. The suspension may be formed as a diaphragm. Alternatively the suspension may comprise a set of resilient arms. The coupling member and the carrier may be annular and the arms may be connected between the coupling member and the carrier to extend circumferentially.

The carrier may have a face adapted for contact with the resonant member and arranged to be fixed thereon, e.g. by adhesive means or by fastening devices. The carrier may be formed integrally with a flange arranged to be fixed to the resonant member. The flange may be disc-like and arranged to support the exciter in a cavity in the resonant member by an edge portion of the flange. The disc may be arranged to close the cavity.

An end of the coil former member may be located and mounted in a recess in the carrier. The coil may be mounted on the outer face of the coil former member.

The magnet assembly may comprise opposed generally disc-like pole pieces sandwiching a magnet, the periphery of one of which pole pieces being disposed within and adjacent to the motor coil assembly, and the periphery of the other of which pole pieces being formed with an upstanding flange arranged to lie adjacent to and to surround the motor coil assembly. The flange may be adapted to interfit with the coupling member. A lip may be formed on the flange, which lip is shaped to interfit with the coupling member, and fixing means on the coupling member may be adapted to engage the lip. A dust seal may be arranged to close the annular coil carrier.

The axially compliant suspension for the magnet assembly may comprise a pair of axially spaced suspension parts or components to facilitate the axial guidance of the voice coil with respect to the motor coil assembly. The suspension parts may be of any desired form, e.g. they may comprise respective sets of resilient arms. The respective outer ends of the resilient arms in each suspension part may be coupled together by posts, the lower ends of which form feet adapted for contact with the resonant member. The inner ends of the arms may carry respective annular coupling members adapted to carry the magnet assembly.

From another aspect the invention is a loudspeaker comprising an inertial vibration exciter as described above.

BRIEF DESCRIPTION OF DRAWINGS

The invention is diagrammatically illustrated, by way of example, in the accompanying drawings, in which.

BEST MODES FOR CARRYING OUT THE INVENTION

FIGS. 1 to 4 disclose a first embodiment of electro-dynamic inertial vibration exciter (1) of the general kind described in parent application Ser. No. 09/011,773 for example for exciting bending wave vibration in a resonant member (2) e.g. a panel-form member of the general kind described in parent application Ser. No. 08/707,012.

Thus the exciter (1) comprises a motor coil assembly (3,4) and a magnet assembly (5,6,7) forming an inertial mass adapted to move relative to the motor coil assembly (3,4), the exciter being adapted to be fixed in any convenient fashion to the resonant member (2) to be excited to impart bending wave energy to the resonant member (2) when an electrical signal is applied thereto.

Figure 1:
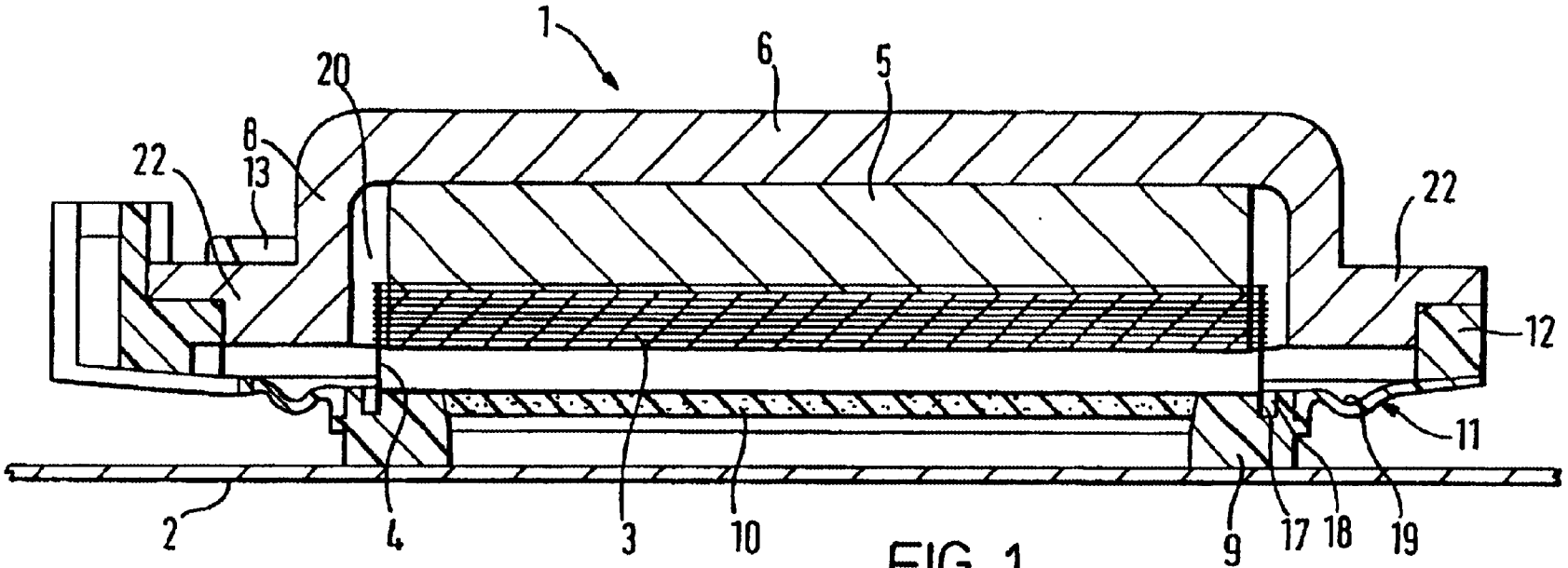
FIG. 1 is a cross-sectional side view of a first embodiment of inertial electro-dynamic vibration exciter in accordance with the present invention.

The motor coil assembly (3,4) comprises a voice coil (3), e.g. of wire, wound on a tubular coil former (4) which is supported at its lower end (17), as seen in FIG. 1, in an annular groove (18) in an annular coil carrier (9) which forms a foot by which the motor coil assembly is secured e.g. by means of an adhesive or the like, to a face of the resonant panel (2). Alternatively the coil carrier could be secured to the resonant member (2) by fixing means, e.g. fasteners. Such fasteners may be releasable. Thus a bayonet connector may be provided, one part of which is fixed to the resonant member and the other part of which is formed integrally with the exciter. The coil former (4) may be secured in the groove (18) by means of an adhesive.

The motor coil assembly (3,4) is surrounded by an annular coupling member (12) which is connected to the motor coil assembly carrier (9) by a resilient annular suspension diaphragm (11) e.g. of rubber-like material which is formed with a concentric annular corrugation (19) to facilitate axial movement of the coupling member relative to the carrier. The carrier (9) and the coupling member (12) may be of hard plastics and may be co-moulded together with the resilient diaphragm (11) to form an integrated suspension component or assembly. The interior of the annular carrier (9) is closed by a disc (10) e.g. of foamed plastics, to form a dust seal closing the interior of the exciter.

The magnet assembly (5,6,7) comprises a disc-like magnet (5) sandwiched between opposed pole pieces (6,7), the one (7) of which is disc-like and is co-extensive with the magnet (5), and the other (6) of which is cup-like and is formed with a downturned flange (8) surrounding the magnet (5) and pole piece (7) to form an annular gap (20) for receiving the voice coil (3). The free end of the flange (8) is formed as an outwardly extending lip (22) which is formed with an annular recess (21) at its outer end to define a socket into which the coupling member (12) can be snugly received in the manner of a spigot and socket joint firmly to hold the magnet assembly and the motor coil assembly together. Snap-action clips (13) on the coupling member (12) engage the lip (22) to prevent disengagement.

The coupling member (12) is formed with a pair of terminal flanges (14) carrying electrical terminals (15) (see FIG. 3) which are electrically connected to the voice coil (3) via coil wires or tails (16), whereby the coil can be connected to a signal source and energised thereby.

Figure 2:
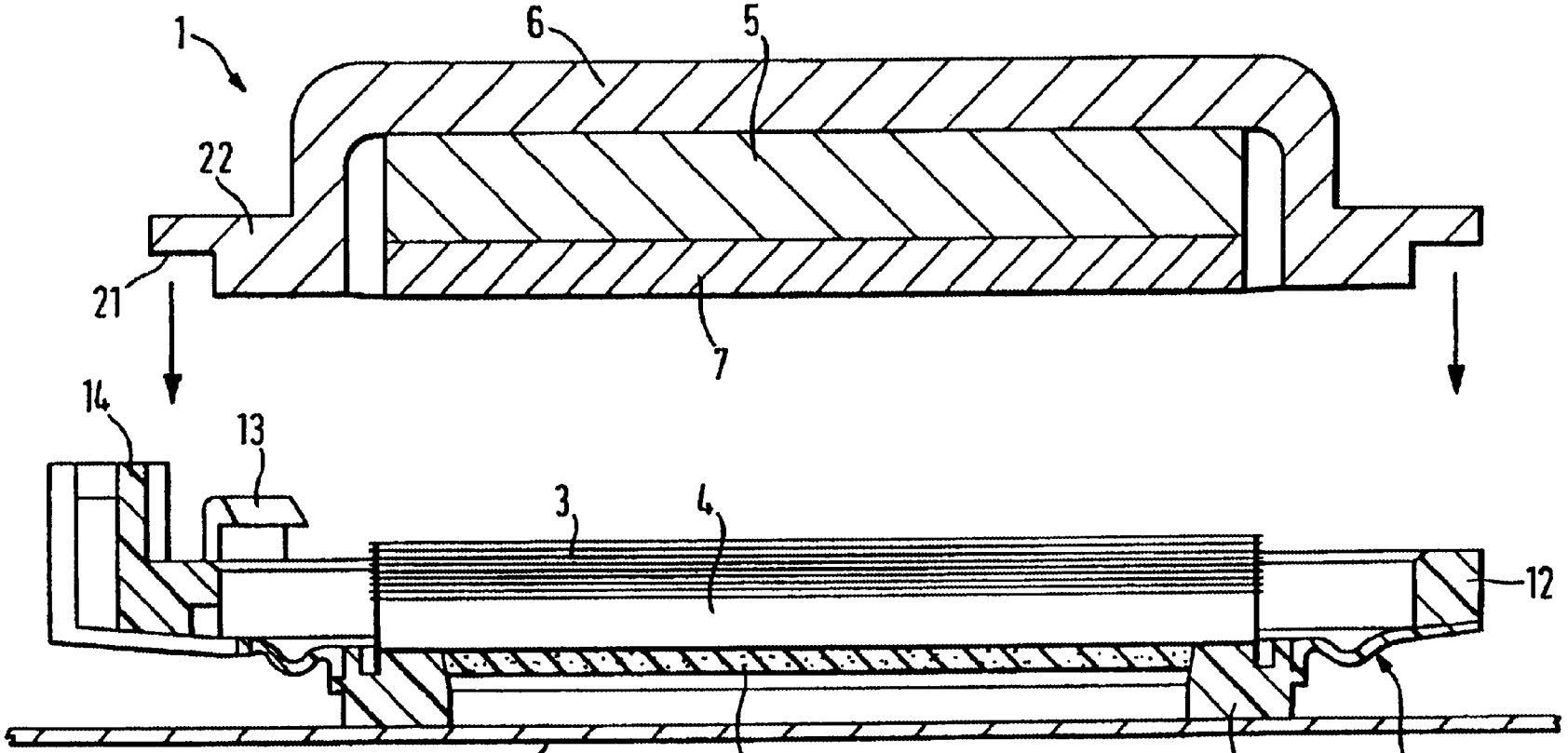
FIG. 2 is an exploded cross-sectional side view of the embodiment of FIG. 1.
Figure 3:
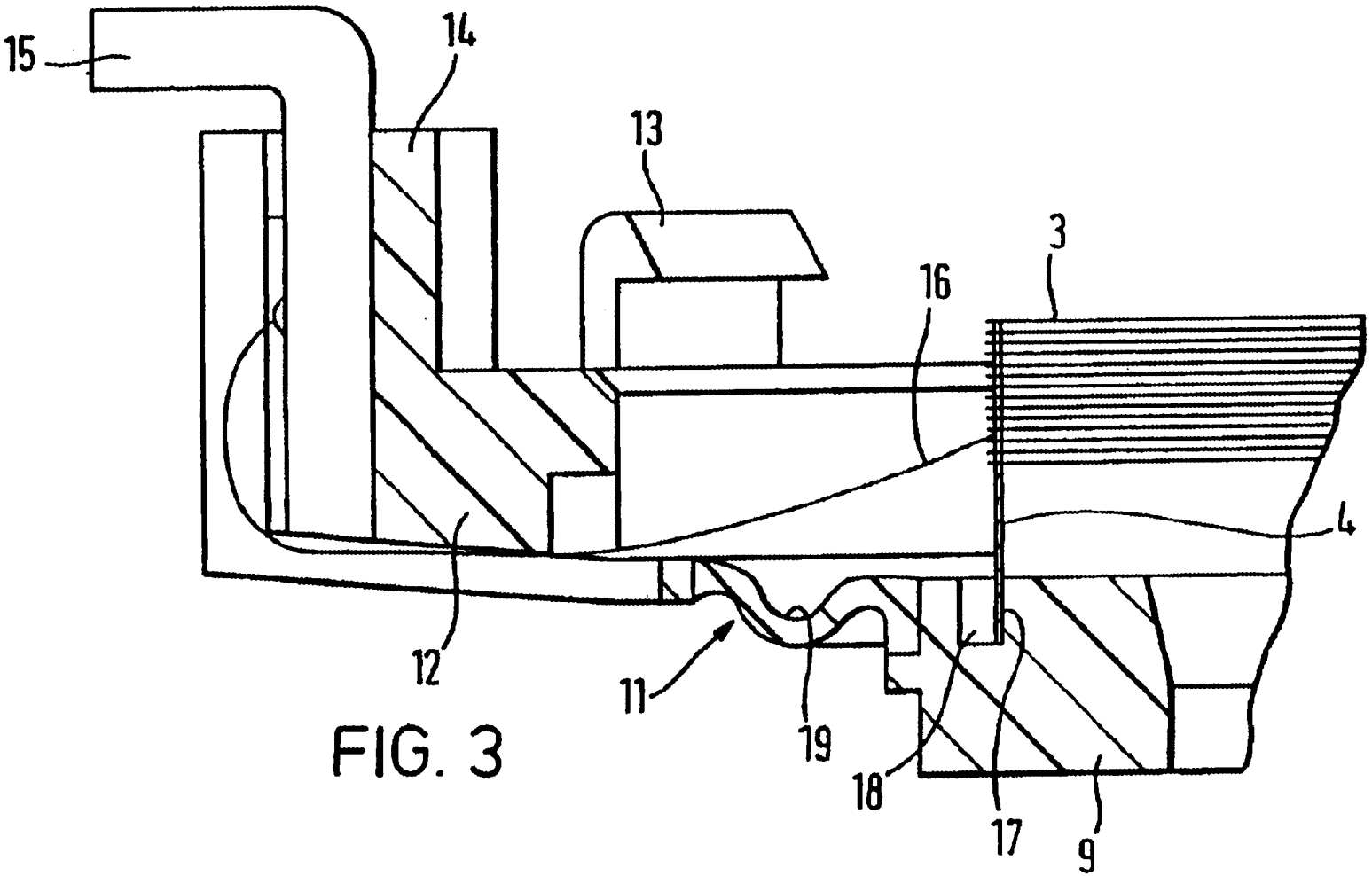
FIG. 3 is an enlarged cross-sectional side view of a detail of the embodiment of FIG. 1.
Figure 4:
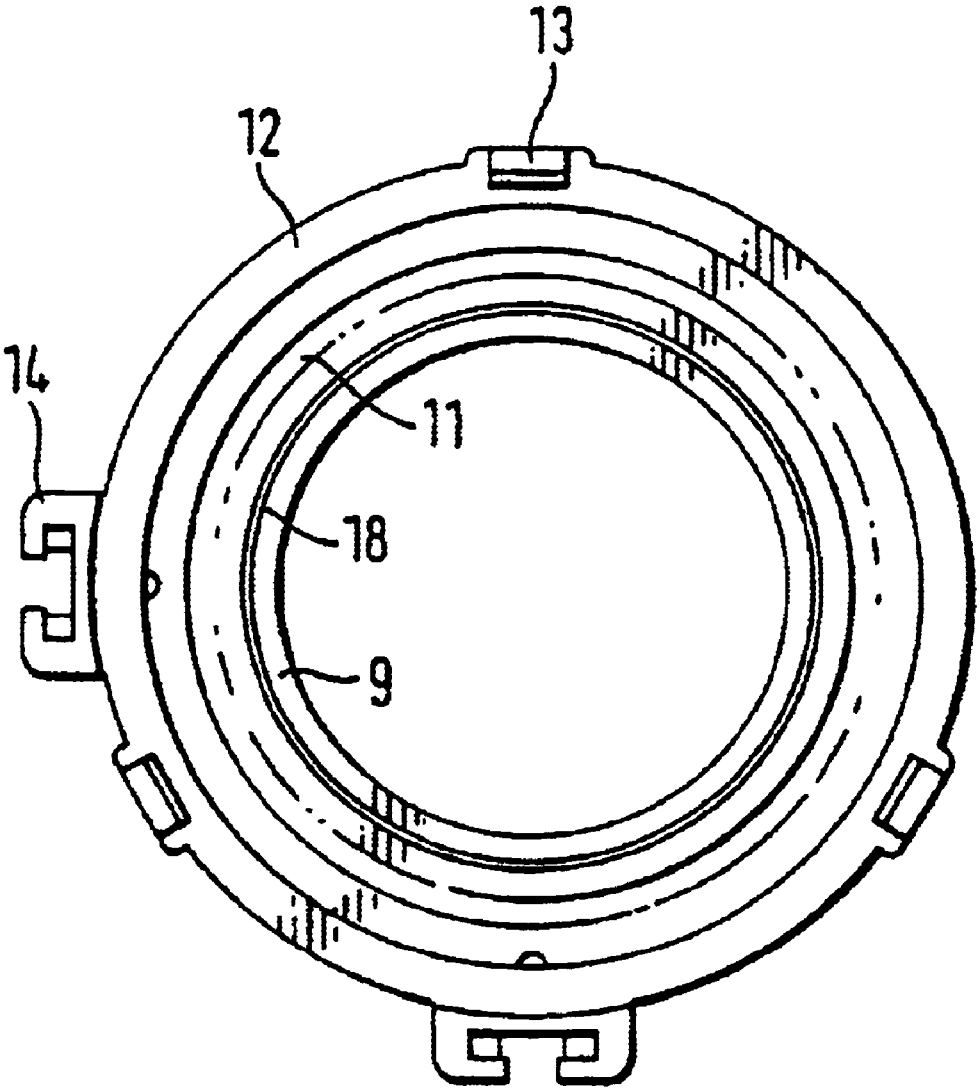
FIG. 4 is a plan view of a suspension component in the embodiment of FIG. 1.
Figure 5:
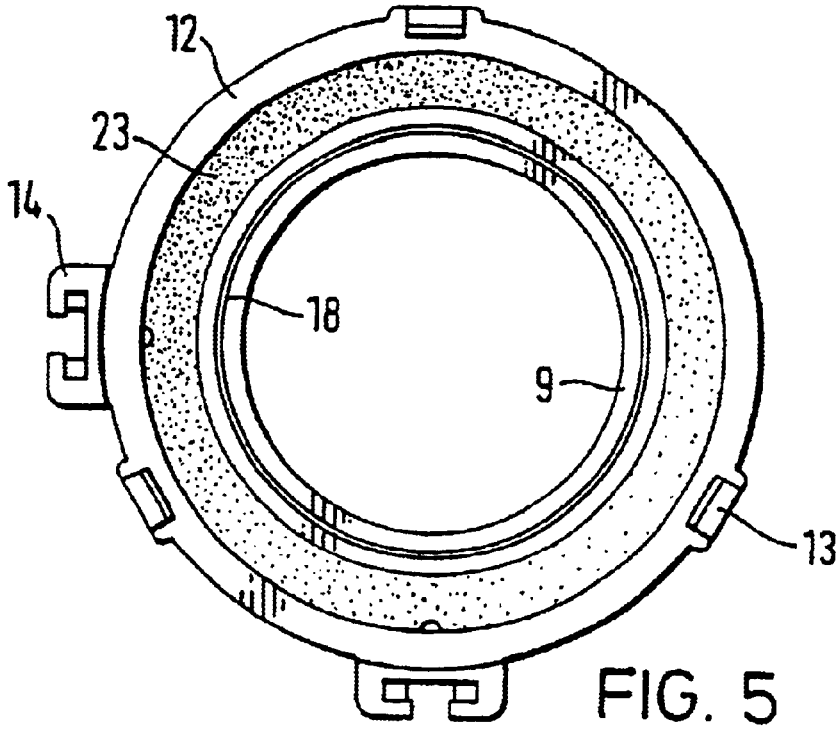
FIG. 5 is a plan view similar to that of FIG. 4 of a modified form of suspension component for use in the embodiment of FIG. 1.

FIG. 5 illustrates a modified form of suspension component or assembly for an exciter as described in FIGS. 1 to 4 in which the resilient diaphragm (11) of FIG. 4 is replaced by a relatively stiff diaphragm (23) of textiles fabric impregnated with a plastics material, e.g. epoxy resin. The diaphragm (23) is formed integrally with the coupling member (12) and the coil carrier (9), e.g. by injection moulding the members (9) and (12) into the diaphragm.

Figure 6:
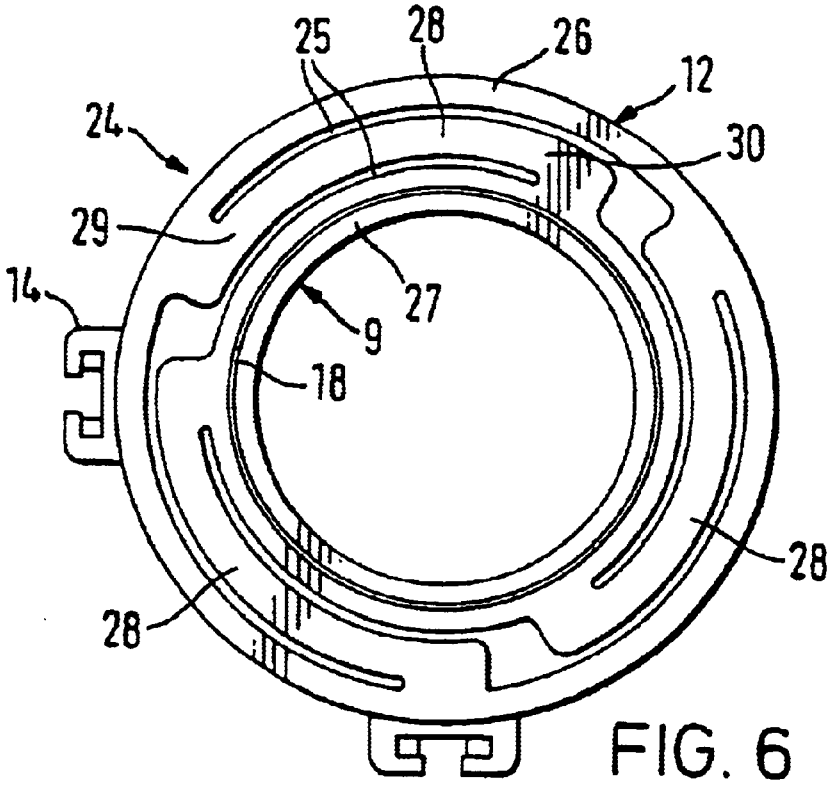
FIG. 6 is a plan view similar to that of FIG. 4 of a further modified form of suspension component for use in an exciter of the kind shown in FIG. 1.

FIG. 6 illustrates an alternative form of suspension component or assembly for an exciter as described in FIGS. 1 to 4 in which the coil carrier (9), the coupling member (12) and a resilient suspension (28) between the two are formed integrally by an annular member (24) of springy plastics material by moulding the annular member with circumferential slots (25) extending part-way round the annular member to divide the member into an outer part (26), which forms the coupling member (12), an inner part (27) which forms the coil support (9), the inner and outer parts being separated and connected by a resilient suspension formed by an array of three arms (28) defined by the slots (25), which arms extend circumferentially of the member (24) and the outer ends (29) of which are coupled to the outer part (26) and the inner ends (30) of which arms are coupled to the inner part (27). Thus the suspension operates by flexure of the resilient arms.

Figure 7:
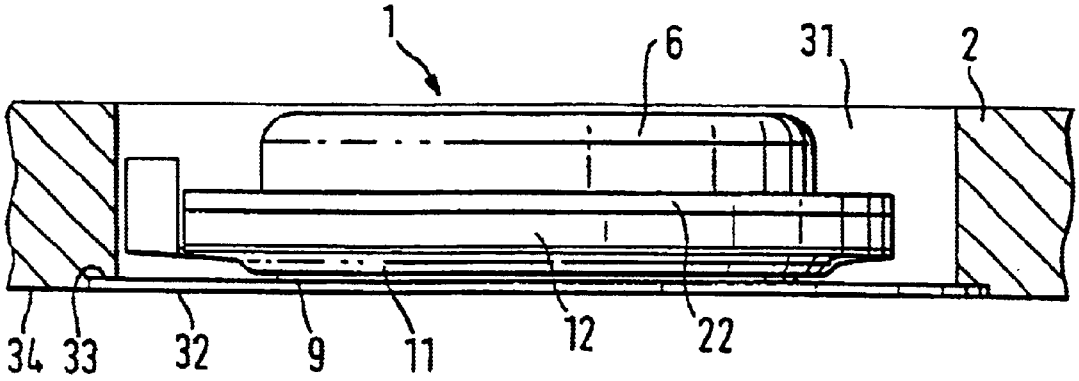
FIG. 7 illustrates an embodiment of inertial electro-dynamic vibration exciter adapted to be embedded within a resonant member to be excited.
Figure 8:
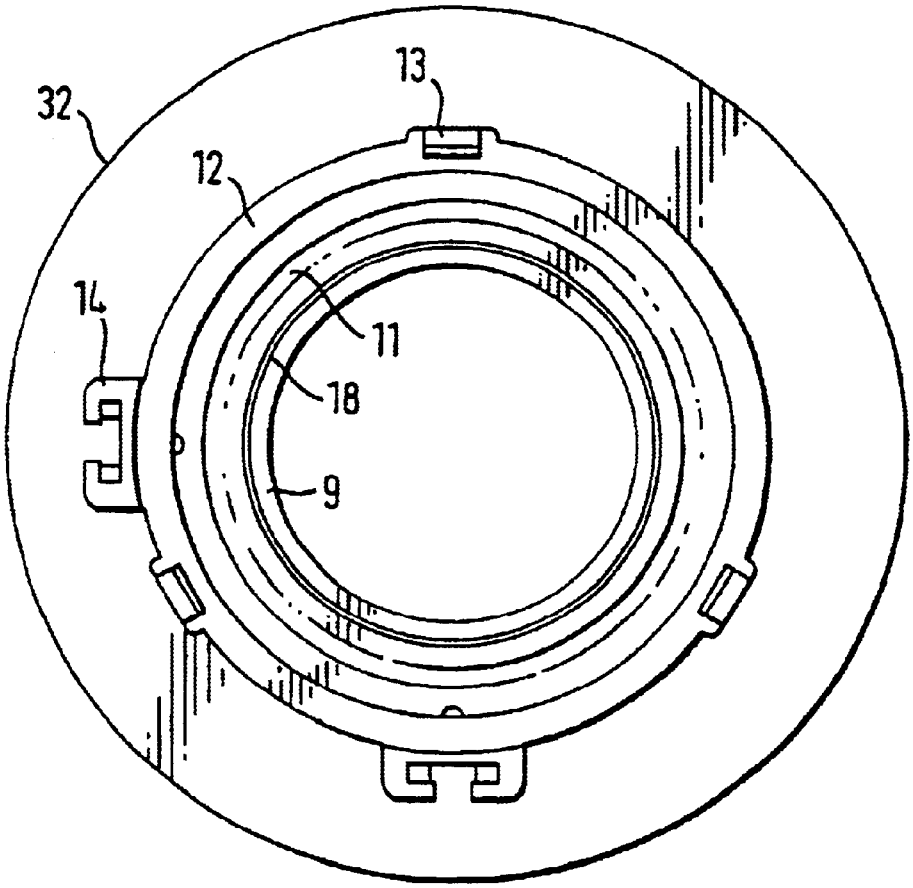
FIG. 8 is a plan view of a suspension component generally similar to that of FIG. 4 for the exciter of FIG. 7.

FIGS. 7 and 8 disclose an arrangement in which an exciter (1) as described above is embedded in a cavity (31) in a resonant panel-form member (2). In this case the carrier (9) is formed integrally with an outwardly extending disc-like flange (32) by which the exciter is mounted in a cavity surrounding recess (33) in a face (34) of the member (2) and whereby the cavity is closed.

Figure 9:
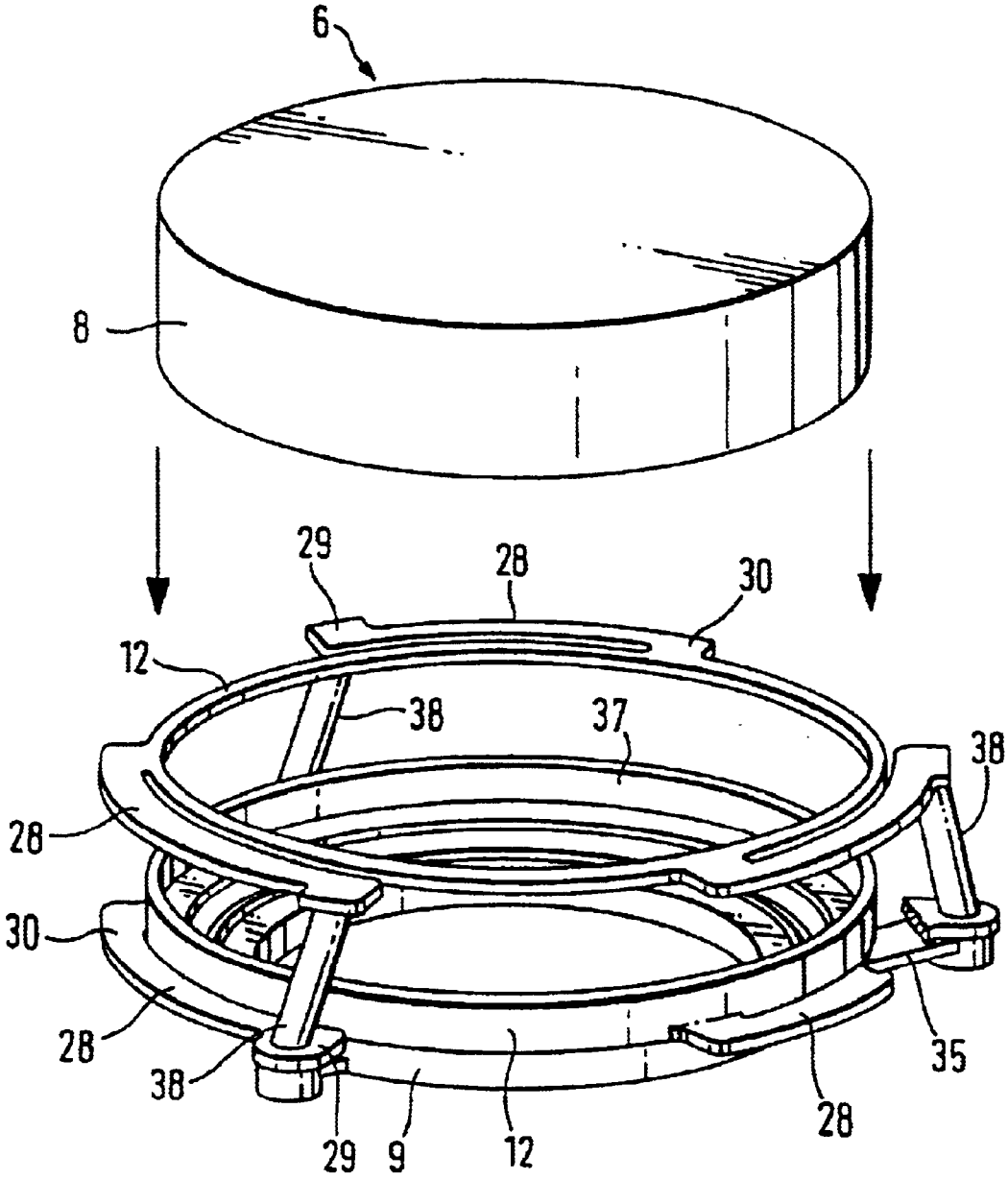
FIG. 9 is a perspective view of a modified form of suspension component for an exciter of the kind shown generally in FIG. 1.
Figure 10:
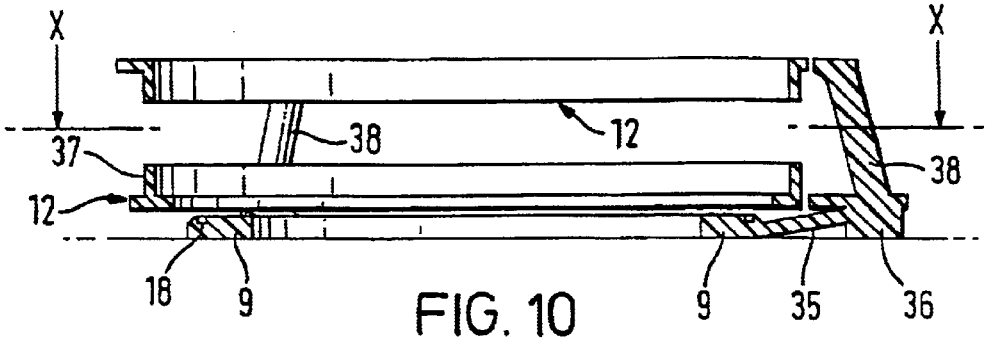
FIG. 10 is a cross-section side view of the suspension component of FIG. 9, taken on the line Y—Y of FIG. 11.
Figure 11:
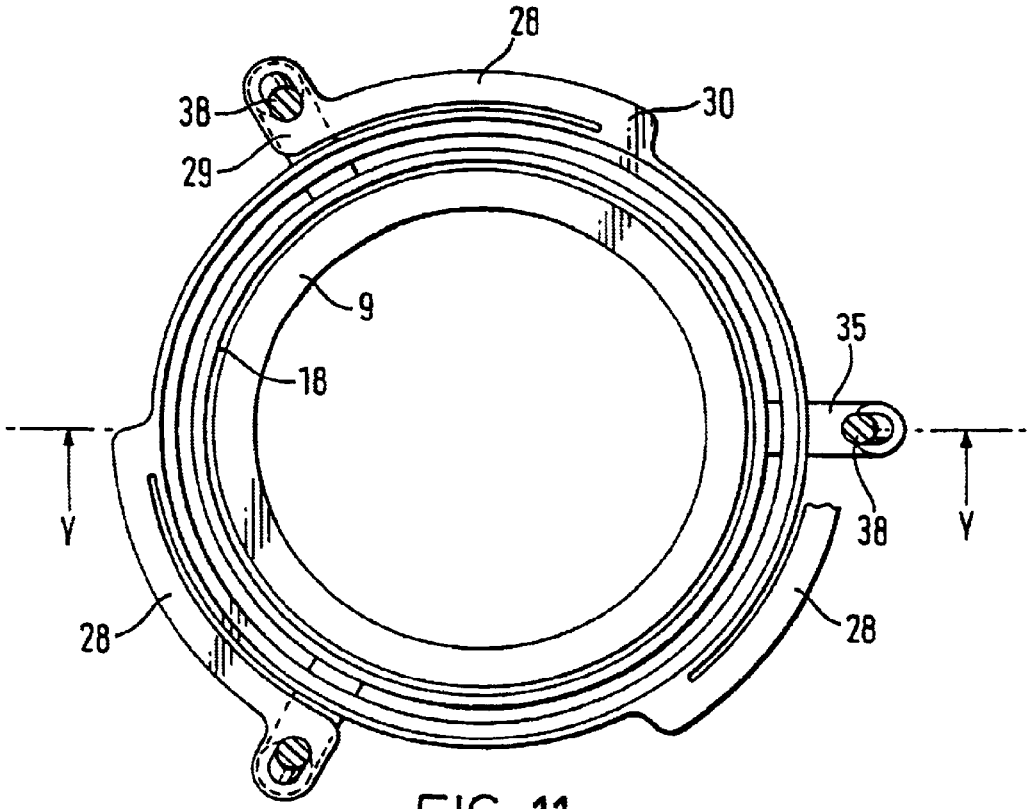
FIG. 11 is a cross-sectional plan view taken on the line X—X of FIG. 10.

In FIGS. 9 to 11 there is disclosed an exciter of the general kind described in FIGS. 1 to 3, employing a modified form of the suspension component or assembly of FIG. 6. In this case however, the suspension component consists of two axially spaced sets of the resilient arms (28), further to enhance the guidance of the magnet assembly (5,6,7) relatively to the motor coil assembly (34). It should be noted that FIG. 9 shows the magnet assembly exploded away from the suspension component, although only the pole piece (6) is visible. Also the suspension component is shown partly broken away at its right hand side, in the interests of clarity.

The suspension component or assembly comprises a single plastics moulding forming the carrier (9) the coupling member (12) and the respective sets of resilient arms (28). The coupling member (12) comprises upper and lower parts as described more fully below.

At its base, the suspension component comprises an annular carrier (9) formed with an annular groove (18) for receiving and locating the end (17) of a coil former (4). An array of connecting bars (35) extend outwardly from the carrier and their outer ends connect to feet (36) which are adapted to rest against the resilient member (2) (not shown). The feet (36) support the outer ends (29) of a lower set of the resilient arms (28).

The inner ends (30) of the lower set of resilient arms carry a lower annular coupling member (12) having an upstanding flange (37) adapted snugly to receive and support the lower end of the flange (8) of the pole piece (6) of a magnet assembly of the general kind shown in FIGS. 1 and 2.

The feet (36) support upwardly extending posts (38) which support an upper suspension member consisting of an upper set of resilient arms (28) carrying an upper annular coupling member (12) adapted snugly to embrace the flange (8) of the pole piece (6). The upper suspension member is arranged such that the upper ends of the support posts carry the outer ends of the set of arms (28), the inner ends of the arms carrying the upper annular coupling member. The upper annular coupling member may comprise fasteners (not shown) which engage the pole piece (6) with snap action to prevent accidental disengagement. Alternatively the pole piece and the suspension may be fixed together by adhesive means.

INDUSTRIAL APPLICABILITY

The invention thus provides convenient ways of manufacturing inertial vibration exciters, including integrated suspension assemblies formed as plastics mouldings or co-mouldings.

What is claimed is:

1. An electro-dynamic inertial vibration exciter (1) for exciting a member (2) having capability to sustain and propagate input vibrational energy comprising a motor coil assembly (3, 4) having a coil (3) rigidly fixed to a tubular coil former member (4), a magnet assembly (5, 6, 7) disposed concentrically with respect to the motor coil assembly and movable axially relative to the motor coil assembly, an axially compliant suspension (11) for the magnet assembly, and a carrier (9) supporting the motor coil assembly (3, 4) and adapted for connection to the member (2) to be excited, further comprising a coupling member (12) adapted to interfit with the magnet assembly (5, 6, 7), and wherein the suspension (11, 23, 24) is connected between the carrier (9) and the coupling member (12).

2. An inertial vibration exciter according to claim 1, wherein the carrier (9) is directly connected to the coil former member (4).

3. An inertial vibration exciter according to claim 1 further comprising means (13) on the coupling member and on the magnet assembly for fixing the coupling member and magnet assembly together.

4. An inertial vibration exciter according to claim 3, wherein the fixing means comprises at least one chip (13).

5. An inertial vibration exciter according to claim 1, wherein the carrier (9) and the suspension (11,23,24) are integral.

6. An inertial vibration exciter according to claim 5, wherein the coupling member (12) and the suspension (11,23,24) are integral.

7. An inertial vibration exciter according to claim 1, wherein the suspension (11,23,24) is resilient.

8. An inertial vibration exciter according to claim 7, wherein the suspension (11,23) is formed as a diaphragm.

9. An inertial vibration exciter according to claim 7, wherein the suspension (24) comprises a set of resilient arms (28).

10. An inertial vibration exciter according to claim 9, wherein the coupling member (12) and the carrier (9) are annular and the arms (28) are connected between the coupling member (12) and the carrier (9) to extend circumferentially.

11. An inertial vibration exciter according to claim 10, further comprising a dust seal (10) closing the annular carrier (9).

12. An inertial vibration exciter according to claim 10, wherein an axial end (17) of the coil former member (4) is located and mounted in a recess (18) in the carrier (9).

13. An inertial vibration exciter according to claim 7, wherein the suspension (24) comprises an axially spaced pair of suspension components (28) which are formed integrally one with the other.

14. An inertial vibration exciter according to claim 13, wherein the axially spaced pair of suspension components (28) are moulded integrally with the coil carrier (9) and with a coupling member (12) for engaging and supporting the magnet assembly.

15. An inertial vibration exciter according to claim 14, wherein the suspension components (28) comprise respective sets of resilient arms (28) each of which is associated with a respective coupling member (12).

16. An inertial vibration exciter according to claim 1, wherein the carrier (9) has a face adapted for contact with the member (2).

17. An inertial vibration exciter according to claim 1, wherein an axial end (17) of the coil former member (4) is located and mounted in a recess (18) in the carrier (9).

18. An inertial vibration exciter according to claim 1, wherein the coil (3) is mounted on the outer face of the coil former member (4).

19. An inertial vibration exciter according to claim 1, wherein the magnet assembly (5, 6, 7) comprises opposed generally disc-like pole pieces (6, 7) sandwiching a magnet (5), the periphery of one (7) of said pole pieces is disposed within and adjacent to the motor coil assembly (3, 4), and the periphery of the other (6) of said pole pieces is formed with a downturned flange (8) arranged to lie adjacent to and to surround the motor coil assembly (3, 4) to form a coil receiving gap (20).

20. An inertial vibration exciter according to claim 19, wherein the flange (8) is adapted to interfit with the coupling member (12).

21. An inertial vibration exciter according to claim 20, further comprising a lip (22) on the flange (8), which lip is shaped to interfit with the coupling member (12), and fixing means (13) on the coupling member adapted to engage the lip (22).

22. An inertial vibration exciter according to claim 1, wherein the coupling member (12) and the suspension (11, 23, 24) are integral.

23. A loudspeaker comprising a member (2) having capability to sustain and propagate input vibrational energy, and an electro-dynamic inertial vibration exciter (1) for exciting said member, said exciter comprising a motor coil assembly (3, 4) having a coil (3) rigidly fixed to a tubular coil former member (4), a magnet assembly (5, 6, 7) disposed concentrically with respect to the motor coil assembly and movable axially relative to the motor coil assembly, an axially compliant suspension (11) for the magnet assembly, and a carrier (9) supporting the motor coil assembly (3, 4) and connected to the member (2) to be excited, further comprising a coupling member (12) adapted to interfit with the magnet assembly (5, 6, 7), and wherein the suspension (11, 23, 24) is connected between the carrier (9) and the coupling member (12).

24. A loudspeaker according to claim 23, wherein the carrier (9) is directly connected to the coil former member (4).

25. A loudspeaker according to claim 23, further comprising means (13) on the coupling member and on the magnet assembly for fixing the coupling member and magnet assembly together.

26. A loudspeaker according to claim 25, wherein the fixing means comprises at least one clip (13).

27. A loudspeaker according to claim 23, wherein the carrier (9) and the suspension (11, 23, 24) are integral.

28. A loudspeaker according to claim 27, wherein the coupling member (12) and the suspension (11, 23, 24) are integral.

29. A loudspeaker according to claim 23, wherein the suspension (11, 23, 24) is resilient.

30. A loudspeaker according to claim 29, wherein the suspension (11, 23) is formed as a diaphragm.

31. A loudspeaker according to claim 29, wherein the suspension (24) comprises a set of resilient arms (28).

32. A loudspeaker according to claim 31, wherein the coupling member (12) and the carrier (9) are annular and the arms (28) are connected between the coupling member (12) and the carrier (9) to extend circumferentially.

33. A loudspeaker according to claim 32, further comprising a dust seal (10) closing the annular carrier (9).

34. A loudspeaker according to claim 32, wherein an axial end (17) of the coil former member (4) is located and mounted in a recess (18) in the carrier (9).

35. A loudspeaker according to claim 29, wherein the suspension (24) comprises an axially spaced pair of suspension components (28) which are formed integrally one with the other.

36. A loudspeaker according to claim 35, wherein the axially spaced pair of suspension components (28) are moulded integrally with the coil carrier (9) and with a coupling member (12) for engaging and supporting the magnet assembly.

37. A loudspeaker according to claim 36, wherein the suspension components (28) comprise respective sets of resilient arms (28) each of which is associated with a respective coupling member (12).

38. A loudspeaker according to claim 23, wherein the carrier (9) has a face in contact with the member (2).

39. A loudspeaker according to claim 23, wherein an axial end (17) of the coil former member (4) is located and mounted in a recess (18) in the carrier (9).

40. A loudspeaker according to claim 23, wherein the coil (3) is mounted on the outer face of the coil former member (4).

41. A loudspeaker according to claim 23, wherein the magnet assembly (5, 6, 7) comprises opposed generally disc-like pole pieces (6, 7) sandwiching a magnet (5), the periphery of one (7) of said pole pieces is disposed within and adjacent to the motor coil assembly (3, 4), and the periphery of the other (6) of said pole pieces is formed with a downturned flange (8) arranged to lie adjacent to and to surround the motor coil assembly (3, 4) to form a coil receiving gap (20).

42. A loudspeaker according to claim 41, wherein the flange (8) is adapted to interfit with the coupling member (12).

43. A loudspeaker according to claim 42, further comprising a lip (22) on the flange (8), which lip is shaped to interfit with the coupling member (12), and fixing means (13) on the coupling member adapted to engage the lip (22).

44. A loudspeaker according to claim 23, wherein the coupling member (12) and the suspension (11, 23, 24) are integral.

* * * * *